US009324340B2

(12) United States Patent
McCoy et al.

(10) Patent No.: US 9,324,340 B2
(45) Date of Patent: Apr. 26, 2016

(54) METHODS AND APPARATUSES FOR USE IN ANIMATING VIDEO CONTENT TO CORRESPOND WITH AUDIO CONTENT

(71) Applicants: Sony Corporation, Tokyo (JP); Sony Network Entertainment International LLC, Los Angeles, CA (US)

(72) Inventors: Charles McCoy, Coronado, CA (US); True Xiong, San Diego, CA (US); Justin Gonzales, San Diego, CA (US)

(73) Assignees: Sony Corporation, Tokyo (JP); Sony Network Entertainment International LLC, Los Angeles, CA (US)

( * ) Notice: Subject to any disclaimer, the term of this patent is extended or adjusted under 35 U.S.C. 154(b) by 68 days.

(21) Appl. No.: 14/152,769

(22) Filed: Jan. 10, 2014

(65) Prior Publication Data

US 2015/0199978 A1 Jul. 16, 2015

(51) Int. Cl.
*G10L 21/055* (2013.01)
*G10L 21/0356* (2013.01)
*G10L 21/10* (2013.01)

(52) U.S. Cl.
CPC ..... *G10L 21/10* (2013.01); *G10L 2021/105* (2013.01)

(58) Field of Classification Search
CPC ..... H04N 21/4307; H04N 21/4325; H04N 21/4331; H04N 21/2368; H04N 5/04; H04N 21/242; H04N 21/44016; H04N 21/8547; H04N 21/234381; H04N 21/8456; G10L 21/043; G10L 25/48
USPC ..... 704/211, 278, 235, 270–271, E19.011; 386/241, 248, 201
See application file for complete search history.

(56) References Cited

U.S. PATENT DOCUMENTS

2012/0323581 A1 12/2012 Stritzel et al.
2013/0132843 A1 * 5/2013 Marnett ..... 715/723
2013/0195428 A1 8/2013 Marks et al.

OTHER PUBLICATIONS

Bregler et al.; Video Rewrite: Driving Visual Speech with Audio; ACM SIGGRAPH 97; http://web.mit.edu/~9.520/www/Papers/VideoRewrite.pdf; 1997; 8 Pages.

* cited by examiner

*Primary Examiner* — Marivelisse Santiago Cordero
*Assistant Examiner* — Stephen M Brinich
(74) *Attorney, Agent, or Firm* — Fitch, Even, Tabin & Flannery LLP

(57) ABSTRACT

Some embodiments provide methods of reanimating multimedia content, comprising: accessing multimedia content; accessing a plurality of dubbed vocalized content; determining a playback duration of a first dubbed vocalized content is different than a first primary vocalized content; identifying a first portion of the primary visual content corresponding to the first primary vocalized content; modifying the first portion of the primary visual content such that a number of frames in the first portion of the primary visual content is changed and has a playback duration that is more consistent with the playback duration of the first dubbed vocalized content; identifying a character movement corresponding to each distinct vocal sound within the first dubbed vocalized content; and reanimating a first character such that reanimated character movements of the first character are consistent and synchronized with the identified character movement corresponding to each of the distinct vocal sounds.

21 Claims, 5 Drawing Sheets

METHODS AND APPARATUSES FOR USE IN ANIMATING VIDEO CONTENT TO CORRESPOND WITH AUDIO CONTENT

BACKGROUND

1. Field of the Invention

The present invention relates generally to multimedia content, and more specifically to modifying multimedia content.

2. Discussion of the Related Art

Multimedia content is often distributed to multiple different locations across the word and/or is viewed by users whose native languages are different than the language in which the multimedia content was originally created. For years, movies have been dubbed into other languages.

This dubbing includes replacing at least part of vocalized content of the multimedia with other dubbed vocalized content in a different language. Further, dubbing allows users to view the multimedia content while hearing the vocalized content in a language that they understand.

SUMMARY OF THE INVENTION

Some embodiments provide methods of reanimating multimedia content, comprising: accessing multimedia content comprising primary visual content and corresponding primary audio content configured to be cooperatively played back by a multimedia playback device; accessing a plurality of dubbed vocalized content each intended to replace one of a plurality of primary vocalized content of the primary audio content; determining that a playback duration of a first dubbed vocalized content is different, by more than a threshold, than a playback duration of a first primary vocalized content of the plurality of primary vocalized content, wherein the first dubbed vocalized content is intended to replace the first primary vocalized content; identifying a first portion of the primary visual content corresponding to and intended to be played back in synchronization with the first primary vocalized content; modifying, through a processor, the first portion of the primary visual content such that a number of frames in the first portion of the primary visual content is changed, wherein the modifying the first portion of the primary visual content produces a first modified portion of the primary visual content, wherein the first modified portion of the primary visual content has a playback duration that is more consistent with the playback duration of the first dubbed vocalized content; identifying a character movement corresponding to each distinct vocal sound within the first dubbed vocalized content; and reanimating at least a portion of a first character depicted in the first modified portion of the primary visual content speaking the first primary vocalized content such that reanimated mouth movements of the first character are consistent with and synchronized with the identified character movements corresponding to each of the distinct vocal sounds within the first dubbed vocalized content.

Further, some embodiments provide apparatuses for use in reanimating video content, comprising: a processor configured to reanimate portions of visual content in cooperation dubbed vocalized content; and processor readable memory accessible by the processor and configured to store program code; wherein the processor is configured, when implementing the program code, to: access multimedia content comprising primary visual content and primary audio content configured to be played back by a multimedia playback device; access a plurality of dubbed vocalized content each intended to replace one of a plurality of primary vocalized content of the primary audio content; determine that a playback duration of a first dubbed vocalized content is different, by more than a threshold, than a playback duration of a first primary vocalized content of the plurality of primary vocalized content, wherein the first dubbed vocalized content is intended to replace the first primary vocalized content; identify a first portion of the primary visual content corresponding to and intended to be played back in synchronization with the first primary vocalized content; modify the first portion of the primary visual content such that a number of frames in the first portion of the primary visual content is changed, wherein the modifying produces a first modified portion of the primary visual content such that the first modified portion of the primary visual content has a playback duration that is more consistent with the playback duration of the first dubbed vocalized content; identify a character movement corresponding to each distinct vocal sound within the first dubbed vocalized content; and reanimate at least a portion of a first character depicted in the first modified portion of the primary visual content speaking the first primary vocalized content such that reanimated character movements of the first character are consistent with and synchronized with the identified character movements corresponding to each of the distinct vocal sounds within the first dubbed vocalized content.

Some embodiments provide methods of reanimating multimedia content, comprising: accessing multimedia content comprising primary visual content and corresponding primary audio content configured to be cooperatively played back by a multimedia playback device; accessing a plurality of dubbed vocalized content each intended to replace one of a plurality of primary vocalized content of the primary audio content; identifying a first portion of the primary visual content corresponding to and intended to be played back in synchronization with the first primary vocalized content; identifying a character movement corresponding to each distinct vocal sound within a first dubbed vocalized content, wherein the first dubbed vocalized content is intended to replace the first primary vocalized content; and reanimating, through a processor, at least a portion of a first character depicted in the first portion of the primary visual content speaking the first primary vocalized content by applying computer generated imagery (CGI) character modeling to generate reanimated character movements of the first character such that the reanimated character movements of the first character are consistent with and synchronized with the identified character movement corresponding to each of the distinct vocal sounds within the first dubbed vocalized content.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
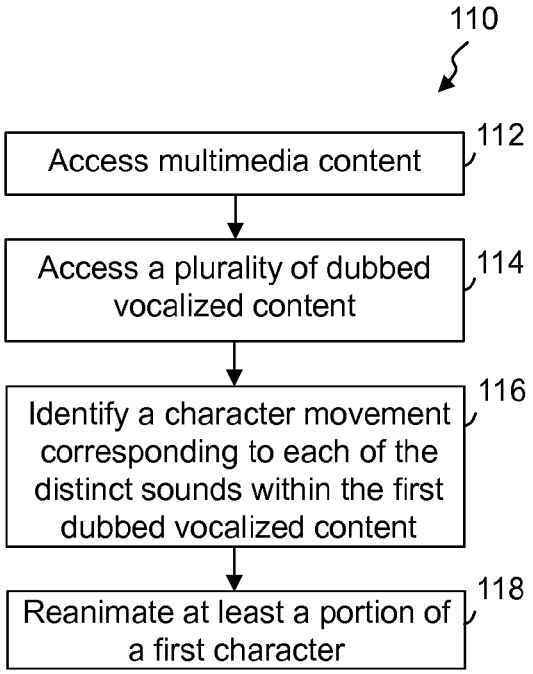
FIG. 1 illustrates a simplified flow diagram of an exemplary process of reanimating content, in accordance with some embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," "some embodiments," "some implementations" or similar language means that a particular feature, structure, or characteristic described in connection with the embodiment is included in at least one embodiment of the present invention. Thus, appearances of the phrases "in one embodiment," "in an embodiment," "in some embodiments," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Larger numbers of multimedia content, such as video content, are distributed to multiple countries throughout the world. Accordingly, it is advantageous to provide the vocal audio content of the multimedia content in the language spoken by the people that are going to consume (e.g., view) the multimedia content. For years, the vocalized content of videos (e.g., movies) has been dubbed to replace the original vocalized content with dubbed vocalized content. Typically, however, the mouth movements of the character speaking the intended audio content do not match the dubbed vocalized content. Instead, there are visual inconsistencies between the character's mouth and the vocalized content. For example, the mouth of the character can appear completely unrelated to the dubbed vocalized content. In some instances the character's mouth may continue moving after the dubbed vocalized content is finished playing back. Similarly, in other instances the character's mouth may stop moving before the corresponding dubbed vocalized content has completed playback and/or the dubbed vocalized content may be played back while another character appears to be speaking. Accordingly, some embodiments provide methods, processes, systems and apparatuses for use in reanimating at least portions of characters within frames of the visual content of video content (e.g., movie) or other such primary multimedia content that include visual content (e.g., frames to be displayed) and corresponding audio content. Further, the reanimation can be implemented in some implementations when the original vocalizations and replacement vocalizations are equal or very similar in length or playback duration such that no timing compensations are made, while in other implementations compensations are made to account for length or playback duration inconsistencies between the primary vocalized content and the dubbed vocalized content.

FIG. 1 illustrates a simplified flow diagram of an exemplary process 110 of reanimating content, in accordance with some embodiments. In step 112, a reanimation system and/or circuitry accesses multimedia content. The reanimation circuitry typically comprises one or more processors, microprocessors, video processors, audio processors, processor and/or computer readable memory other such circuitry that is configured to process and store multimedia content. The reanimation circuitry can be configured to provide an automated reanimation, and in some instances, can provide the reanimation with little or no user interaction. In some implementations, some or all of the reanimation provided may be evaluated by a human evaluator, the reanimation circuitry and/or an evaluation system, allowing subsequent reanimation of some or all of the previously reanimated content based on the evaluation. Further, as described above and further below, the multimedia content comprises both visual content (e.g., frames of video) and corresponding audio content that is configured to be cooperatively played back in accordance with multimedia playback timing. For example, the multimedia content can be substantially any content that has visual content that corresponds with vocalized audio content that is to be dubbed with different dubbed vocalized content, whether dubbed into a different language, dubbed with different information or other such dubbing. Additionally, the multimedia content can be, but is not limited to, a movie, television programming, an animated movie, an animated cartoon, short clip video, and/or other such relevant multimedia content.

The audio content of the multimedia content, referred to below as the primary audio content, includes multiple primary vocalized content corresponding to when one or more characters (e.g., actor, cartoon character, etc.) depicted in frames in the primary visual content are speaking. Accordingly, in dubbing the multimedia content some if not all of the primary vocalized content are to be replaced with dubbed vocalized content. Correspondingly, in some embodiments, at least a portion of the primary visual content is reanimated to account for the dubbed vocalized content.

In step 114, a plurality of dubbed vocalized content are accessed. For example, the reanimation circuitry may access locally and/or remotely stored dubbed vocalized content. Each of the plurality of dubbed vocalized content is intended to replace one of the plurality of primary vocalized content of the primary audio content. Further, in some instances, the dubbed vocalized content is provided as part of the multimedia content, while in other instances it is separate. In some embodiments, the dubbed vocalized content is evaluated to identify distinct vocal sounds within the first dubbed vocalized content. These vocal sounds, sometimes referred to as phonemes, are the basic sound structures that are cooperated and/or concatenated when spoken to make up words and phrases. Different languages may have some different distinct vocal sounds; however, many vocal sounds extend across multiple different languages.

In step 116, one or more character movements (e.g., mouth shape, mouth movements, facial features, facial expressions, head movement, etc.) corresponding to each of the distinct vocal sounds within the first dubbed vocalized content are determined. The character movements often include mouth shape, which can comprises, for example, mouth position, lip positions, tongue position and/or articulations, teeth exposure or other features or combinations of such features of mouth orientation and/or facial shape for a language that can affect the sound of a vocal sound. The mouth shape is sometimes referred to as a viseme, and in some instances is any of several speech sounds which look the same. The identification of the character movements (e.g., mouth shapes, mouth movements, etc.) corresponding to vocal sounds can be determined based on one or more databases and/or mappings that identify character movements relative to distinct vocal sounds, an evaluation of still images and/or video content tracking mouth movement and/or shape, and/or other such methods. Some embodiments generate a mapping based on an evaluation and/or recording of facial and/or mouth shapes and associated vocal sounds. For example, in some embodiments a speaker is video recorded and/or still images of the speaker are taken as she/he generates the dubbed vocalized content. The mouth, and in some embodiments surrounding facial features, can be identified, located and/or tracked to identify the mouth shape that corresponds to a vocal sound. Further, some embodiments employ an automated system that evaluates the mouth movements and generates the modeling corresponding to the mouth movements. The modeling can then be applied in generating at least a portion of the reanimation. For example, in some instances, measurements of mouth movements can be made of an actor that generates the dubbed vocalized content to generate the mapping and/or modeling of the mouth shape corresponding to the one or more vocal sounds. Some implementations measure mouth movements of a speaker or actor other than the person that created the dubbed vocalized content to be used for the audio portion of the dubbed video, where the alternative actor that is measured mimics the vocalizations to be animated. This can allow measurements to be made corresponding to vocalizations, for example, where only audio recordings of the performance may be available.

In some implementations, the anatomy of the character in the visual content corresponding to the dubbed audio may not have a human anatomy, such as a talking dog, an alien, a computer generated fantasy creature, or the like. In other cases, the character corresponding to the dubbed audio may be a robot, radio, or other inanimate object. In such cases, the "movements" of the character speaking the dubbed vocalized content may have a different relationship to the source audio than that of a character with a mouth anatomy similar to a human. For example, a robot may blink its eyes or create a wave form in a line corresponding to its vocalizations when it speaks. An animated radio may be drawn with lines emanating from its speaker or may even change size and/or shape corresponding to the sound it is emitting to look like it is more actively producing the sound. The correlations between the characters movements and the vocal sounds can be identified to determine appropriate movements and correlate those movements to the dubbed vocal sounds for that character.

Additionally or alternatively, one or more databases associated with different languages can be generated that maps mouth movements to vocal sounds and/or combinations of vocal sounds. These databases can readily be accessed in evaluating the dubbed vocalized content to identify modeling and/or portions of reanimated frames that can be used in the reanimation. Further, some embodiments generate and/or utilize settings to guide the mapping of movements. Such settings can include, but are not limited to, characteristics of a character's, actor's or speaker's tendencies. For example, one or more settings can correspond to a particular character that tends to have smaller mouth movements, tends to open their mouth wider than normal for certain positions, lips separate further apart on one side of the mouth than the other, generally speaks out of the side of her/his mouth, and other such tendencies or combinations of such tendencies.

In step 118, a reanimation is generated corresponding to the character depicted in the primary visual content that is speaking the primary vocalized content to be dubbed. The reanimation, in some embodiments, includes reanimating at least a portion of the character speaking the primary vocalized content to be dubbed such that reanimated character movements of the character are consistent with and synchronized with the identified character movement corresponding to each of the distinct vocal sounds within the dubbed vocalized content. In some instances, the reanimation can include at least replacing the mouth portion of the depicted character within one or more frames corresponding in playback timing with the dubbed vocalized content. Accordingly, in at least some embodiments, at least a part of the character speaking is reanimated such that the character's depicted mouth is shaped consistent with and synchronized with the identified mouth shapes corresponding to the distinct vocal sounds within the dubbed vocalized content. Further, some embodiments reanimate at least a portion of a character depicted in the portion of the primary visual content by applying computer generated imagery (CGI) character modeling to generate reanimated character movements of the first character such that the reanimated character movements of the first character are consistent with and synchronized with the identified character movement corresponding to each of the distinct vocal sounds within the first dubbed vocalized content.

In some embodiments, the reanimation further includes applying morphing and/or blending technique or performing other such modifications to reduce and/or eliminate inconsistencies, discontinuities, and/or other such indications of the reanimation. In some embodiments, step 118 further includes an evaluation of the reanimation and/or synchronization between at least the reanimation and the dubbed vocalized content. The evaluation may be an automated evaluation performed by the reanimation circuitry, an evaluation system, and/or a combination thereof. Further, an evaluation may additionally or alternatively be performed by a human evaluator (e.g., editor, artist, etc.). Based on the evaluation, further reanimation may be performed (e.g., repeating some or all of the process 110) to improve some or all of the reanimation. Some embodiments apply one or more metrics relative to one or more thresholds. For example, mouth movements of a reanimated character can be automatically tracked to identify mouth shapes that are associated with playback timing. This timing can be compared (e.g., using mapping) with distinct vocal sounds of the dubbed vocalized content to confirm accurate reanimation of the mouth movements and/or the synchronization.

Once reanimated the primary visual content will appear, when played back in synchronization with the dubbed audio content, as though the multimedia content was originally generated with the character speaking in the dubbed language, and in some instances avoiding the appearance as though the character's mouth is not speaking the same words and/or limiting or avoiding the character's mouth from stopping movement too soon, continuing to move once the dubbed vocalized content has completed playback, and other such inconsistencies. The reanimation provided reduces production time, at least in part, because the reanimation can be at least partially automated. Further, the reanimation may be limited to just a portion of the character (e.g., the mouth). Still further, the reanimation is typically limited to reanimating frames when a character's mouth is visible and moving and does not reanimate those frames where the mouth is not moving or is not visible.

Figure 2:
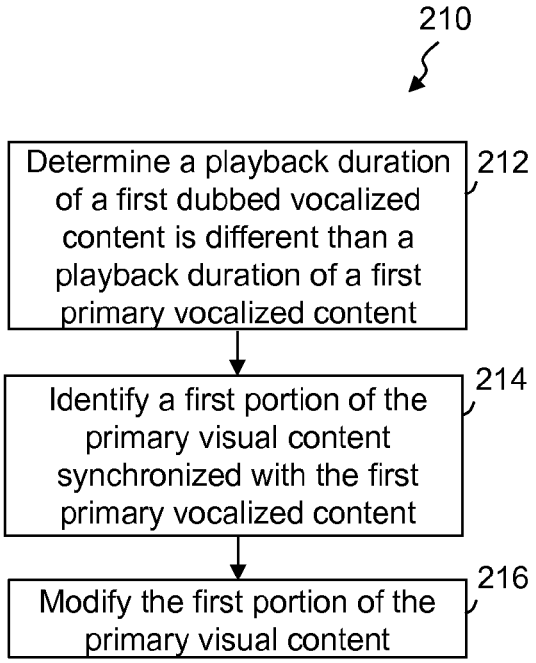
FIG. 2 illustrates a simplified flow diagram of an exemplary process configured to modify the playback of the visual content to be more consistent with the dubbed audio content, in accordance with some embodiments.

FIG. 2 illustrates a simplified flow diagram of an exemplary process 210 configured to modify the playback of the visual content to be more consistent with the dubbed audio content, in accordance with some embodiments. Often, some or all of the steps of the process 210 are implemented in cooperation with the process 110, and in some instances process 110 and 210 may be considered a single process. In other instances, the process 210 is implemented separate and distinct from the process 110, and in some implementations some or all of the steps of 210 are implemented at a different time than the process 110. Further, in many embodiments, the process 210 is at least partially implemented through an automated process with little or no user input.

In step 212, the dubbed vocalized content is evaluated relative to the primary vocalized content to determine whether a playback duration of dubbed vocalized content (e.g., a first dubbed vocalized content), which is intended to replace primary vocalized content (e.g., a first primary vocalized content), is different than a playback duration of the primary vocalized content that the dubbed vocalized content is intended to replace. In many instances, the primary vocalized content is one of a plurality of primary vocalized contents that are to be replaced by one of a plurality of dubbed vocalized content. Again, often when dubbing vocalized content, such as dubbing into a different language, the time to playback the dubbed vocalized content for a vocal sound, word, phase, sentence, series of sentences or the like may be significantly different than a vocal sound, word, phrase, sentence, series of sentences, etc. of the primary vocalized content that are being replaced. For example, some words or phrases in a first language may not have corresponding words or phrases in a second language, and as such may require significantly larger number of words in the second language to provide an accurate translation. Similarly, the dubbed vocalized content may be shorter than the primary vocalized content being replaced.

Accordingly, in replacing primary vocalized content the duration of playback for the dubbed vocalized content may not be consistent with the playback timing or duration of the primary vocalized content. As such, some embodiments identify in step 212 when there is a difference in playback duration between, for example, a first primary vocalized content and a first dubbed vocalized content that is to replace the first primary vocalized content. In some embodiments, the difference in duration is further evaluated relative to one or more thresholds and when the difference has a predefined relationship with a threshold, further action may be taken, such as modifying one of the primary visual content and/or the dubbed vocalized content.

In step 214, a portion of the primary visual content corresponding to and intended to be played back in synchronization with the first primary vocalized content being dubbed is identified. In some embodiments, one or more frames of the primary visualized content timed to be synchronously displayed during the playback of a first primary vocalized content are identified. Typically, a portion of the primary visual content has a playback duration that is the same as the playback duration of the primary vocalized content being dubbed over. Accordingly, visual inconsistencies between the dubbed vocalized content and the primary visual content may result when the primary vocalized content is replaced by the dubbed vocalized content.

In step 216, the identified portion of the primary visual content, which is intended to be displayed while the primary vocalized content being replaced is to be played back, is modified. Typically, this modification is intended to compensate for at least some of the playback difference and/or inconsistencies between, for example, a first dubbed vocalized content replacing a first primary vocalized content. In some embodiments, the modification of the first portion of the primary visual content is such that a number of frames in the first portion of the primary visual content is changed producing a first modified portion of the primary visual content having a playback duration that is more consistent with the playback duration of the first dubbed vocalized content. Similarly, in some embodiments, the modification of the primary visual content comprises adding one or more frames or removing one or more frames.

Often, the source scene duration is mapped to the dubbed scene duration. Again, in some embodiments, frames can be repeated or dropped (e.g., at regular intervals) to create a new source that has a playback duration that has substantially the same duration as the resulting dubbed scene. This new time compensated source video often still needs the character's mouth movements to be reanimated or otherwise adjusted. In some cases, one or more frames can be interpolated, morphed or otherwise adjusted to provide for smooth movements. For example, when the camera is panning in the scene, the amount of panning can leave the background panned a number of pixels that is part way between the amount of panning in two consecutive frames from the source to provide a smooth flow of movement in the resulting video. In some cases where the video is created from an animation, the movements in the original model, such as a pan of the background during a scene, can be adjusted to meet the new timing of the scene.

Further, in some embodiments, metadata defined with the multimedia content is evaluated to identify locations within the primary visual content (and/or primary audio content) where modifications can be implemented and/or where modifications are less likely to be detected by a viewer. For example, the metadata may define portions of a scene that are fairly static and/or where a background is fairly static, define that a background is performing a pan (which may include specifics about the pan, such as direction of pan, pace of panning, etc.), and other such metadata that can be used in identifying portions of the primary visual content (and/or primary audio content) where modifications would likely be less detectable.

The modification produces a modified portion of the primary visual content having a playback duration that is more consistent with the playback duration of the dubbed vocalized content, and in some instances the modified portion of the primary visual content has a playback duration that is substantially the same as the playback duration of the first dubbed vocalized content. In some embodiments, other modifications may additionally be made in attempts to further reduce the playback duration differences when the modification to the primary visual content does not achieve a desired relationship between the playback durations of the modified primary visual content and the dubbed vocalized content.

Referring back to step 212, in many embodiments the evaluation in step 212 further includes determining, when a playback difference is detected, whether the difference in playback duration between the dubbed vocalized content and the primary vocalized content is equal to or is greater than one or more duration thresholds. In some implementations, where the duration difference does not have the corresponding relationship with certain threshold, the process 210 may ignore the difference and terminate the process 210, and/or may implement other changes to try and at least partially compensate for the difference (e.g., modifying playback speed of the dubbed vocalized content). For example, if the difference in playback duration is substantially small it may not be detected by a user and as such it is ignored. As another example, if the duration difference is relatively small, the difference may be accounted for by shifting when playback the dubbed vocalized content is started (i.e., a start time of the dubbed vocalized content relative to one or more frames within the primary visual content and/or modified primary visual content). Alternatively or additionally, some embodiments may modify the playback speed of the dubbed vocalized content to compensate for at least some of the difference in playback durations. For example, the dubbed vocalized content can be modified such that a duration of playback is altered, in response to determining that the playback duration of the dubbed vocalized content is different than the playback duration of the primary visual content such that the modified dubbed vocalized content has a modified playback duration Different thresholds may correspond to different actions to be taken. For example, a first threshold may correspond to when the playback duration of the dubbed vocalized content is greater than the playback duration of the primary vocalized content and one or more actions may be taken to increase the playback duration of the visual content (e.g., adding one or more frames) and/or actions may be taken to speed up or shorten the playback of the dubbed vocalized content. Similarly, a second threshold may correspond to when the playback duration of the dubbed vocalized content is less than the playback duration of the primary vocalized content and one or more actions may be taken to decrease the playback duration of the visual content (e.g., remove one or more frames) and/or actions may be taken to slow down or extend the playback of the dubbed vocalized content (e.g., extending silent periods, slowing the speed, etc.). Other thresholds may additionally or alternatively apply, and other actions may correspond to the identified relationships relative to the one or more other thresholds.

Further, some embodiments can evaluate the resulting visual content. For example, if the movement of a character's head differs enough from the original position, an action could be trigger to calculate modified or new background pixels for the pixels that are no longer obscured by the character's head. This can be calculated from the same portion of the background in other frames where that portion is not obscured, or could be calculated from the rest of the background to unobtrusively blend with the portion of the background that was not obscured in the original frame(s). This modification may be implemented, as an example, in scenes with a side view of the character where a portion of the background is alternatively exposed and obscured as the characters mouth opens and closes.

Similarly, the degree of background activity might hit a threshold where it would be undesirable to lengthen or shorten the duration to an extent to create the most desirable duration based on the dubbed vocalizations. In such a case the duration of the dubbed vocalizations may be altered. Depending on the amount that the dubbed vocalizations are modified, the pitch may need to be changed to compensate for the change in duration. Again there may be a threshold based on the degree of modification made to the dubbed vocalization duration, which may also take into account the degree of variation in pitch between various other dubbed vocalizations for that character.

Still further, some embodiments evaluate the mouth movements of the character to be reanimated based on the dubbed vocal sounds to determine whether the mouth movement is sufficiently similar to the mouth movement that is consistent with one or more dubbed vocal sounds to limit and/or avoid reanimation of some or all of a series of frames. For example, some implementations may evaluate the mouth positions of the character to be reanimated relative to predicted mouth movements for one or more dubbed vocal sounds and determine whether the variation has a predefined relationship with a threshold in deciding whether to implement reanimation of one or more frames. As such, some embodiments utilize one or more thresholds so that if the mouth positions corresponding to one or more dubbed vocal sounds do not differ much from the original mouth positions of the character to potentially be reanimated, especially with respect to the timing of percussive sounds and when the mouth is closed or open, the primary visual content may be used without modification and/or reanimation.

As indicated above, other modifications may additionally or alternatively be made in attempts to further reduce the playback duration differences when the modification to the primary visual content does not achieve a desired relationship between the playback durations of the modified primary visual content and the dubbed vocalized content. For example, some embodiments modify the dubbed vocalized content in attempt to reduce the differences in playback duration. In some instance, the playback of the dubbed vocalized content may be sped up or slowed down. Typically, there is a limit on the amount of change in playback speed so that the change is not readily apparent to a view. Further, the changed speed may depend on an evaluation of the primary content, such as whether rapid changes are taking place (e.g., scene changes), amount of background and/or other audio content, and other such aspects.

Figure 3:
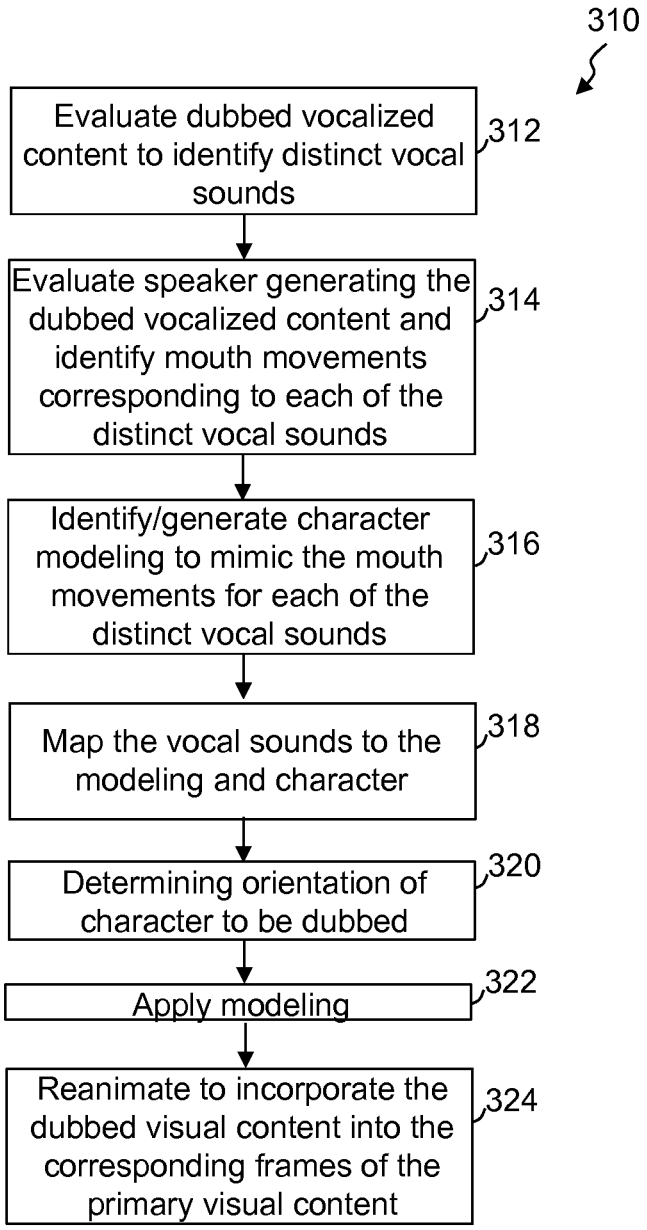
FIG. 3 depicts a simplified flow diagram of an exemplary process of reanimating a character within primary visual content to correspond with dubbed vocalized content, in accordance with some embodiments.

FIG. 3 depicts a simplified flow diagram of an exemplary process 310 of animating a character in generating a primary visual content to correspond with primary vocalized content and/or reanimating a character within primary visual content to correspond with dubbed vocalized content, in accordance with some embodiments. Although generally described below with reference to reanimation, the process 310 can also be applied in animating characters for primary content. In step 312, dubbed vocalized content (or primary vocalized content) is evaluated to identify distinct vocal sounds. The timing of these distinct vocal sounds is typically also noted relative to the dubbed vocalized content. In step 314, mouth movements corresponding to the vocalized sounds are identified. In some embodiments, a speaker generating the primary or dubbed vocalized content is evaluated to identify mouth movements and/or shapes corresponding to each of the distinct vocal sounds and/or combinations of the vocal sounds. For example, in some embodiments a speaker vocalizing the dubbed vocalized content is video recorded and/or still images are taken while the voice actor or speaker is speaking to capture the shape of the speaker's mouth. As described above, the shape of the speaker's mouth typically comprises one or more of mouth position, lip positions, tongue position and/or articulations, teeth exposure or other features or combinations of such features of mouth orientation and/or facial shape or expressions. In some embodiments, markers can be added to areas around and/or on the speaker's mouth to enhance tracking and evaluation. Further, in some embodiments, when mouth movements are automatically derived from analysis of mouth movements of a speaker (e.g., voice actor), the data correlating the mouth movements to the analysis of the voice actor can be saved with an initial animation and/or the reanimation to aid in determination of portions in reanimating to correspond with the dubbed vocalized content and the new voice actor.

In step 316, character modeling is identified and/or generated to mimic the mouth movements for each of the distinct vocal sounds and/or combinations of vocal sounds. In some embodiments, the modeling is computer generated imagery (CGI) character modeling implemented through software applications in rendering a computer generated character or one or more portions of a computer generated character (e.g., generating the mouth portion of a character). The modeling may be predefined and selected based on the evaluation of the speaker, may be based on knowledge of the language of the dubbed content, while in some implementations some or all of the modeling may be generated. For example, the evaluation of the speaker's mouth may be used to at least in part generate the modeling. In some embodiments, one or more points of interest may be specified on the images of the speaker's mouth and used to generate or modify modeling to create the modeling needed to generate at least the reanimated portion of the character in the primary visual content (e.g., computer-vision techniques may be used to track points on speaker's mouth). Typically, modeling is identified and/or generated to correspond with one or more of the identified distinct vocal sounds within the dubbed vocalized content. In some implementations, two or more vocal sounds are cooperated and modeling is identified and/or generated for the combined vocal sounds. Additionally or alternatively, modeling can be generated and/or identified to correspond to each of the identified distinct vocal sounds.

Further, in some implementations and/or depending on the character being reanimated, the modeling may further generate more than just the mouth. For example, in some instances, the modeling may reanimate the mouth movement as well as one or more of the nose, the eyes, cheeks, chin, or combinations thereof, or an entire head, the torso and/or other parts of the character. In some implementations, the modeling may reanimate the entire character. Further, some or an entire facial expression can be important to convey an emotion of what the character is saying. For example, when a character within the primary content or a voice actor breaks into a wide-eyed facial expression of amazement after a particular word or phrase, the reanimation may include a reanimation of more than just the mouth such that the reanimated character has the same or a similar facial expression at the corresponding playback of the dubbed vocalized content. Furthermore, in some embodiments, a character may be reanimated to perform sign language corresponding to the vocalizations, which may or may not be different from the original vocalizations. In such a case the character's hands, and potentially some or all of the character's arms and/or torso, could be reanimated. In the case of a computer animation, this could be done by manipulating the computer model for the character before rendering the frames again. Some embodiments additionally apply morphing and/or other such processing to manipulate hand and arm positions from the positions the character is shown in the original video and/or to compensate variations between the primary visual content and the reanimation and incorporation of the reanimation of the hands (and potentially portions of or all of the arms and torso).

In step 318, a mapping is generated that maps the vocal sounds to the character modeling. In step 320, the primary visual content is evaluated to identify an orientation of the character, corresponding to the primary vocalized content, that is to be dubbed. Often, a character within the primary visual content is not facing directly toward the camera (or audience when being played back). Accordingly, the view of the character's mouth is often affected by the orientation of the character, whether the character is a real life actor captured during filing, an animated character generated by hand and/or computer generation, or combinations thereof. As such, some embodiments identify an orientation of the character and/or the character's mouth in the primary visual content so that the modeling can compensate for the visual orientation of the character. Further, the orientation is typically identified over a period of the primary visual content corresponding to the primary vocalized content to be dubbed over, and often orientation is identified in each corresponding frame of the primary visual content. The identification of the orientation can include identifying a character's eyes, noise, mouth and/or other features that can be used to determine an orientation of the character.

In step 322, the identified modeling is applied in generating at least a portion of the reanimated visual content that corresponds to the vocal sounds of the dubbed vocalized content. This generation of the reanimated visual content can include, when relevant, compensating for the identified orientation of the character and/or compensating for other character movements already defined (e.g., movement of head, body, etc.). In step 324, the primary visual content is reanimated to incorporate the reanimated visual content and/or portion of the reanimated visual content into the relevant corresponding frames of the primary visual content. As described above, in many embodiments, this can include replacing some or all of the character. As such, the reanimation provides a rendering of at least the portion of the character to be dubbed while applying the selected plurality of character modelings such that the depicted mouth of the character is shaped consistent with and synchronized with the identified mouth shapes corresponding to each of the distinct vocal sounds (or combinations of sounds) within the dubbed vocalized content. For example, the reanimation includes replacing a portion of the character surrounding and including the mouth with at least a reanimated portion of visual content that comprises a corresponding portion of a mouth and a corresponding surrounding area.

Further, the primary visual content may be compartmentalized and/or include multiple components or aspects that are cooperated to render an entire frame and/or scene(s). For example, the primary visual content may comprise a background compartment or aspect, one or more character compartments or aspects and/or other aspects or compartments (e.g., foreground aspect, strategically placed aspects, advertising aspects, etc.). These aspects can be distinct aspects that are cooperated together upon rendering to generate the primary visual content. Similarly, aspects or components may include separate audio tracks for the speech being replaced from the rest of the audio content (e.g., different speech, different sound effects, different music, etc.). Similarly if the scene was created using a green screen and composited together reanimation can be configured to start with the original source parts or aspects (e.g., first character) and reanimate the portion that is changed based on modeling (e.g., reanimate a portion of just the first character), then reapply the compositing. An example of reanimating aspects can include using computer models, where reanimation can adjust the portion of the source computer model that is to be changed. Accordingly, the reanimation may comprise reanimating a visual aspect or a portion of a visual aspect that is cooperated with the one or more aspects when rendered to generate the reanimated visual content. For example, reanimating the character or a portion of the character can include superimposing the rendered character including the reanimated portion of the character with a separately rendered background.

For example, a scene may have been filmed with one or more actors in front of a green screen, with scenery and/or foreground objects composited later. Accordingly, some embodiments, in reanimating perform a reanimation of the relevant one or more actors in front of the green screen before compositing the rest of the original sources with the reanimated green screen video. Similarly, in some implementations, visual content (e.g., the video or portion of the video) may have been generated through computer animation. In such a case, the model of the character or characters being reanimated to correspond with the dubbed vocalized content can be modified to adjust the mouth (and when relevant head) positioning to correspond to the new dubbed vocalized content. The adjusted model can be rendered in generating the new frames of reanimated visual content.

Some embodiments, in reanimated one or more frames to correspond to dubbed vocalized content, utilize previous frames of the multimedia content to extract at least portions of a character's mouth that can be stitched into later frames in place of the same or a different character's mouth to effect at least some of the reanimation. This use of previous frames can be used in animated and non-animated multimedia content, but may be particularly beneficial with non-animated multimedia content, such as television and/or movies with real actors portraying the characters, and even more beneficial with live, streamed, and/or real-time multimedia content where there typically is limited time to implement the dubbing. For example, this reanimation using portions of previous frames can be effective with live content and/or streaming content, such as new broadcasts, sporting events, and other such multimedia content.

As such, some embodiments evaluate vocalized content corresponding to a character (e.g., announcer, news anchor, character in a television show, etc.) to identify vocal sounds and/or combinations of sounds, and associates or maps corresponding frames to the sounds. Portions of one or more the frames (e.g., mouth area of the character) may be extracted that correspond to each vocalized sounds and/or combinations of sounds, and used in subsequent frames corresponding to dubbed vocalized content. This allows reanimation using extracted portions of frame from primary visual content in subsequent frames. This process is not limited to a single multimedia content, but instead can be applied to multiple different multimedia content. For example, the extracted portions of frames in one episode of a television series can be used in reanimating one or more subsequent episodes. Similarly, frames from a previous broadcast (e.g., previous news broadcast, sports broadcast, etc.) can be used in reanimating a separate later broadcast. As another example, frames from a first movie that includes a certain actor may be used in reanimating subsequent movies that includes the same actor.

Figure 4:
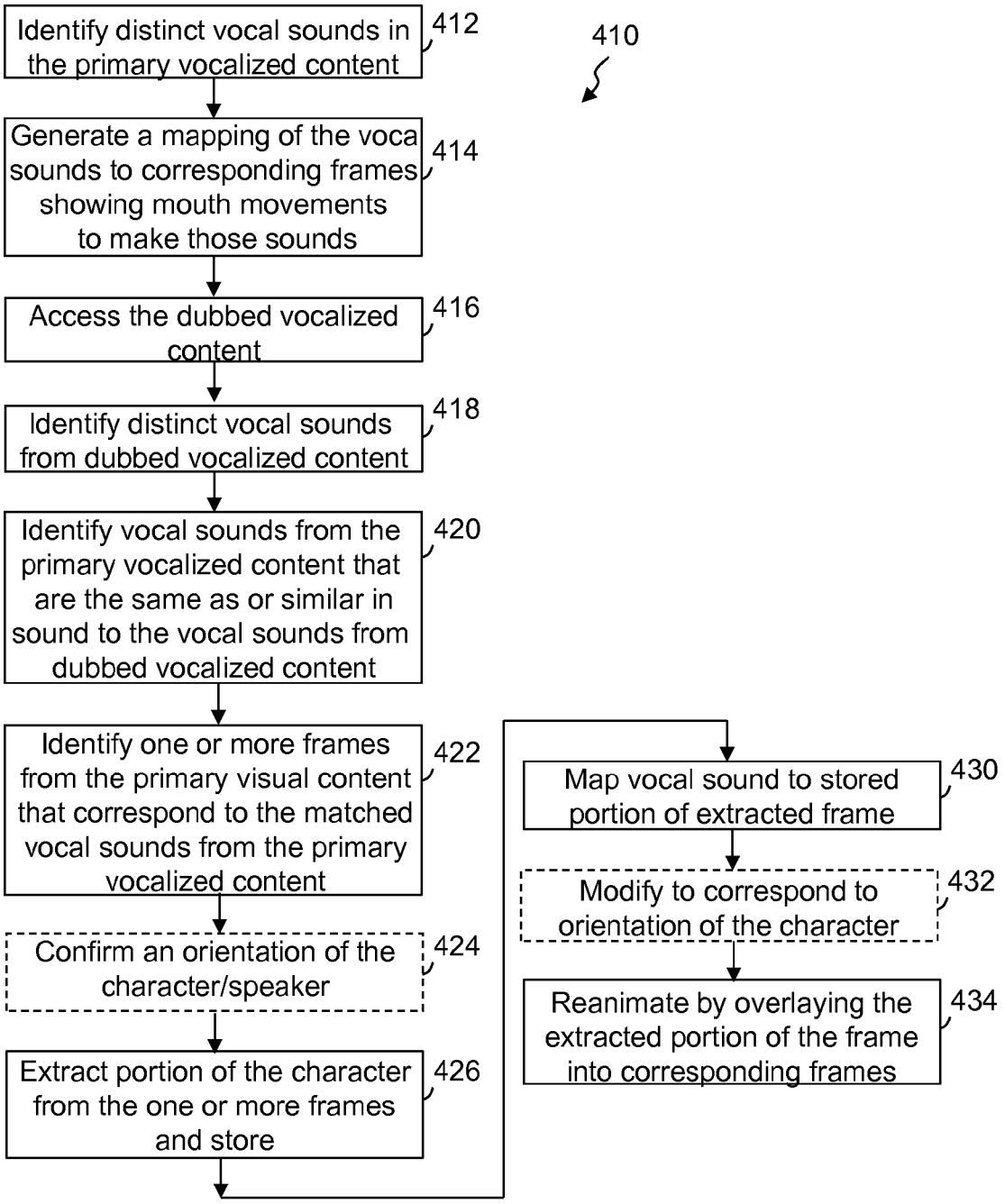
FIG. 4 shows a simplified flow diagram of an exemplary process of reanimating primary visual content in accordance with some embodiments.

FIG. 4 shows a simplified flow diagram of an exemplary process 410 of reanimating primary visual content in accordance with some embodiments. In step 412, distinct vocal sounds are identified in the primary vocalized content (e.g., vowel sounds, consonant sounds, etc.), and one or more frames intended to be displayed in synchronization with each of the identified vocal sounds is identified. Some embodiments may further identify one or more combinations of distinct vocal sounds. By utilizing the primary vocalized content, one or more portions of the primary visualized content may be identified and used, at least in part, in replacing portions of frames of the primary content when reanimating the primary visual content.

In step 414, a mapping is generated of the vocal sounds and/or combinations of vocal sounds of the primary vocalized content to one or more corresponding frames showing mouth shapes and/or movements to make those vocal sounds. Typically, the same vocal sound (or combination of vocal sounds) is repeated many different times over a duration of a playback of the primary content. Accordingly, there are typically many different frames or sets of frames distributed throughout one or more portions of the primary visual content that correspond to the distinct vocal sounds or combinations of vocal sounds. The mapping can associate the one or more frames and/or sets of frames with the vocal sound or combination of vocal sounds. In some implementations, the mapping further includes associating the mapping with the character speaking (e.g., sounds produced by a first character are mapped to frames where the first character is speaking or otherwise producing those sounds; while a mapping may be defined to associate frames to a second character when the second character is speaking or otherwise making the vocal sounds). Still further, some embodiments evaluate within the identified frames an orientation of the character speaking. The mapping can associate the orientation of the character with the vocal sound (and/or combination of sounds) and the corresponding frame or frames associated with the orientation.

In step 416, the dubbed vocalized content is accessed. In step 418, distinct vocal sounds and/or combinations of vocal sounds are identified from the dubbed vocalized content. In some embodiments, the dubbed vocalized content is evaluated to identify the sounds. In other embodiments, information and/or metadata may be provided that identify the vocal sounds and a corresponding timing. In step 420, the vocal sounds from the primary vocalized content are identified that are the same as or substantially similar in sound to one or more corresponding vocal sounds from the dubbed vocalized content. In some embodiments, a mapping is generated associating the similar vocal sounds between the primary vocalized content and the dubbed vocalized content.

In step 422, one or more frames from the primary visual content are identified from the mapping, which match vocal sounds from the primary vocalized content, that correspond and/or are mapped to the dubbed vocal sounds and/or combinations of sounds. As such, one or more primary or source frames or portions of the primary frames from the primary visual content are identified that when displayed appear to be generating the corresponding dubbed vocal sounds. Some embodiments include optional step 424, where an orientation of the character speaking the vocal sound from the primary vocalized content in the identified one or more primary frames is evaluated to identify an orientation that most closely corresponds to an orientation of the character in the one or more frames to be reanimated and correspond to the dubbed vocalized content.

In step 426, at least a portion of the character (e.g., mouth and potentially a surrounding area, such as some or all of the chin and/or the nose) from the one or more primary frames are extracted and stored. Some embodiments extract more of the character (e.g., mouth, nose, eyes, the entire head, a portion of the torso and head, etc.), or less (e.g., just the lips and area between the lips, etc.). Similarly, some embodiments may extract the entire character and/or portions of the frame surrounding the character. In step 430, the vocal sounds of the dubbed vocalized content are mapped to the stored extracted portions of the primary frames. Again, the mapping may include information about an orientation of the character. Some embodiments optionally include step 432, where the one or more primary frames corresponding to a vocal sound or combination of sounds of the dubbed vocalized content are modified, for example, to compensate for a different orientation of the character being dubbed relative to the portion of the frame being used for reanimation. In step 434, the primary visual content is reanimated by replacing or overlaying the extracted portion of the one or more primary frames into corresponding frames of the primary visual content being reanimated producing the reanimated visual content. In some embodiments, the reanimation further includes applying morphing and/or blending technique to combine the portions of the primary frames into the frames being reanimated or performing other such modifications to reduce and/or eliminate indications of the reanimation (e.g., lines, artifacts, inconsistencies in color, orientation, and/or other such factors that can detract from the visual continuity of the frame and/or the character).

Some embodiments further utilize surrounding frames in the reanimation. For example, the position of an object (e.g., character or other objects or background) in frames can be identified and/or tracked such that when the new timing corresponds to a time between existing frames, the object can be taken from one of the frames and located in the interpolated position between the two frames. Some embodiments further evaluate positioning in multiple frames and generate reanimation that is a combination of positioning from multiple frames in generating the reanimation. Accordingly, in some implementations, when an object is changing over multiple frames (e.g., appearance of movement), then the reanimation of the object that is used can be a morph between the object from the two or more surrounding frames. Further, if the timing of the frame is closer to one frame than the other of two other frames, then the object from the closer frame can be used, or that object can be weighted heaver in the morphing process. Similarly, the background can be taken from frames in whichever direction the object does not obscure that portion of the background.

Accordingly, some embodiments utilize frames, and typically portions of frames, from an early part of a multimedia content (or other multimedia content) to replace portions of later frames in reanimating the later frames so that the character speaking appears to have originally said the dubbed vocalized content. In some instances, the reanimation later in the playback of a multimedia content may appear more accurate than earlier in the playback due at least in part to the time needed to identify a sufficient amount of vocal sounds and corresponding frames, and the number of vocal sounds and the corresponding frames identified that can be used in the reanimation. As such, reanimation utilizing this process may improve as the multimedia content continues to be played back.

Again, some embodiments further take into consideration an orientation of the character when speaking the vocal sounds when selecting a portion of one or more primary frames to be inserted into subsequent frames to effect the reanimation. As an example, first and second primary frames may be identified and mapped to a first dubbed vocal sound. The first reanimation frame may show the character looking toward the viewer's right, while the second reanimation frame mapped to the first dubbed vocal sound shows the character looking generally toward the viewer's left. A third frame to be reanimated and corresponding to the first dubbed vocal content can be evaluated to identify the orientation of the character. If it is determined that the orientation of the character in the third frame to be reanimated is looking toward the viewer's left, the second frame may be selected as the reanimation frame to be used in reanimating the third frame. Again, blending, morphing and/or other techniques may be applied to reduce and/or eliminate indications of the reanimation.

In some embodiments, the primary vocalization content can be analyzed for syllables or sequences of syllables such that the syllables and/or sequences of syllables from the dubbed vocalization content are mapped to the primary vocalizations. This mapping can, in some implementations, be normalized for differences in the pitch and/or tone of the voice used for the dubbed vocalizations. The mouth positions that the dubbed vocalizations most closely map to can be used for the portion of the video with which the portion of the dubbed vocalizations correspond. Further, the source video may be used for the mouth rendering directly when other factors are the same, such as the size and orientation of the head and the lighting conditions.

Often, in video content, there are sound effects, music and/or other characters speaking that may occur proximate with or simultaneously with vocalized content being dubbed. As described above, some embodiments modify the reanimated visual content and/or the dubbed vocalized content in order to provide a reanimation of the primary content so that the reanimated visual content is substantially synchronized with the dubbed vocalized content. The sound effects, music, vocalized content of another character, and/or other such audio content, however, may not necessarily correspond because of the modification to the reanimated visual content and/or the dubbed vocalized content.

Figure 5:
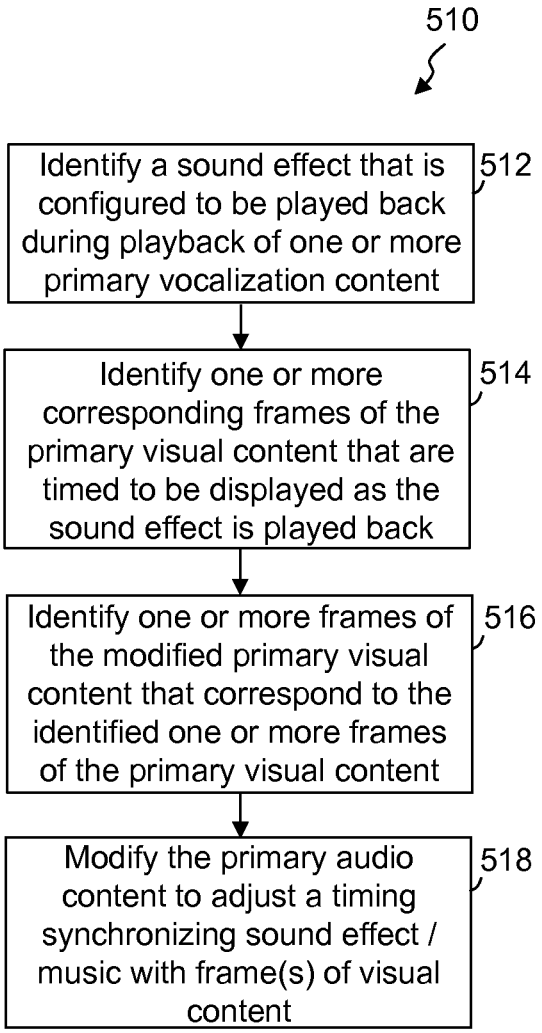
FIG. 5 shows a simplified flow diagram of an exemplary process of synchronizing sound effects, music, other characters' vocalized content (whether dubbed or not) and/or other audio with reanimated visual content, in accordance with some embodiments.

FIG. 5 shows a simplified flow diagram of an exemplary process 510 of synchronizing sound effects, music, other characters' vocalized content (whether dubbed or not) and/or other audio with reanimated visual content, in accordance with some embodiments. In step 512, the audio content of the primary content is evaluated to identify one or more sound effects, portions of music and/or other audio content that are configured to be played back during playback of one or more vocal sounds of the primary vocalized content that are being dubbed. In step 514, one or more corresponding frames of the primary visual content are identified that are timed to be displayed as the sound effect, portion of music, or other audio content is played back. In step 516, one or more frames of the modified reanimated visual content are identified that correspond to the identified one or more frames of the primary visual content.

In step 518, the primary audio content is modified to adjust a timing of when the one or more sound effects, portions of the music, etc. are is to be played back, and/or the sound effects or music are modified (e.g., adding or removing a certain number of beats) to be in synchronization with the displaying of the identified one or more frames of the modified portion of the primary visual content. The modification may include redefining a start time, extending a duration of the sound effect, shortening a duration of the sound effect, extending and/or shortening a duration of playback of one or more portions of music, and/or other such modifications.

Further, in instances where there may be sound effects other than vocalizations in the primary audio content, those sound effects likely correspond to action in the video.

Accordingly, in some embodiments the reanimation attempts to synchronize and/or line up the sound effects with the same frame of the source video, even if the timing is modified and frames are added or removed. This may be particularly relevant and/or important with sudden sounds, like bangs, clicks, or pops, where any misalignment of the frame and the sound effect with which it corresponds to may be easily noticed by a viewer. Further, similar to componentized video elements, the primary audio content may be the final rendered audio from the source video, or the audio content from the source may have individual source audio tracks available. When separate individual audio tracks are available then some embodiments limit the modification to just the audio corresponding to the character or characters being dubbed, then the individual source tracks and modified audio tracks can be mixed back together to create the final audio tracks.

For example, in some embodiments a sound effect is identified that is configured to be played back during playback of the first primary vocalization content. One or more corresponding frames of the first portion of the primary visual content are identified that are timed to be displayed as the sound effect is played back (e.g., an explosion occurs in the background). Further, one or more frames of the first modified, reanimated portion of the primary visual content are identified that correspond to the one or more frames of the first portion of the primary visual content that are timed to be displayed as the sound effect is played back. The primary audio content is modified to adjust a timing of when the sound effect is to be played back such that the sound effect, when played back, is played back in synchronization with the displaying of the identified one or more reanimated frames of the first reanimated portion of the primary visual content to be played back while the sound effect is played back.

As described above, some embodiments utilize metadata to evaluating primary multimedia content in implementing the reanimation and/or dubbing. The metadata can be specific to a frame, a series of frames, a scene, a portion of music, a sound, a character, the entire multimedia content and the like. Further, the metadata can provide information and/or define parameters that can be used in reanimating and/or dubbing, such as but not limited to timing information, synchronization information (e.g., between frames and audio content, between aspects of the audio content (e.g., spoken content and sound effects and/or music), etc.), background information (e.g., panning, light intensity, static, rapid changes, etc.), foreground information, character information (e.g., orientation, movement, etc.), and other such information.

Some embodiments utilize the metadata in reanimating the multimedia content. In some embodiments, the metadata can be advantageous when modifying one or more portions of multimedia content (e.g., modifying the primary visual content). The metadata can be identified that corresponds with the portion of the visual content. Again, the metadata can provide various information. For example, in some embodiments the metadata identifies characteristics regarding a background depicted behind and around a character being reanimated. The metadata can be evaluated to identify one or more frames within a first portion of the visual content where modifications can be implemented. For example, the metadata may define that a background is relatively static over a specified number of frames where modification to the primary visual content would be less apparent. As another example, the evaluation of the metadata can identify one or more frames where panning is occurring within the background and with which one or more frames may be added or removed without adversely affecting a visual continuity of the background. Accordingly, the modification of the portion of the primary visual content can include modifying the portion of the primary visual content relative to at least one of the one or more frames identified from the evaluation of the metadata.

The metadata may additionally or alternatively be utilized in synchronizing the dubbed vocalized content, the primary audio content, sound effects, music and/or the modification of timing of sound effects, music, etc. In some embodiments, sound effects, music and/or other audio aspects of the audio content may be identified, at least in part, by accessing metadata corresponding to at least the audio content. The metadata may identify, for example, the sound effect and further identify timing, the one or more corresponding frames of the first portion of the primary visual content and other such information. In other instances, the metadata may define areas of music where modifications are less likely to be detected (e.g., the addition or removal of one or more beats, repeating a portion of the music, extending or shortening a sound effect, etc.). Further, some embodiments add metadata and/or rewriting some of the metadata when reanimating to provide information about the reanimation and/or the association of the audio content to the visual content (e.g., to define associating one or more of frames of a first modified portion of the primary visual content that correspond to a sound effect and/or a modified sound effect, timing information for synchronization, associating dubbed vocalized content, etc.).

In many instances, computer animations are rich in metadata as there is a model (e.g., of the world) that is being rendered. Many things, such as the location, time of day, or even the force of gravity (such as in an outer space scene), will be defined and/or known as part of the source model(s). The models for computer animation can even be rich enough to allow calculation of the reflections that can be seen in a character's eyes or even a character's teeth. A computer model of some or all of a character may include information about the stiffness of the characters joints, which would determine the rate at which the movement in those joints can change. Such meta-data modeling can be created from the source video, such as analyzing the character to determine the range over which the character's jaw accelerates as they speak. Such a model can be used so that the reanimation is relatively consistent with and/or would not stray from the ranges of motion and acceleration that the character used in the primary visual content. Such a model may include, for example, a minimum time it takes the character to open its mouth and close its mouth again.

Figure 6:
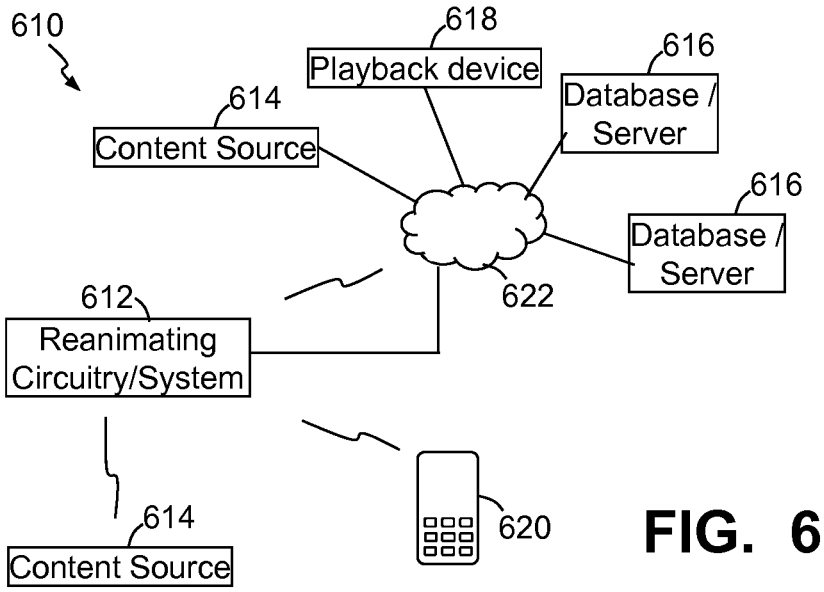
FIG. 6 shows a simplified block diagram of an exemplary system to perform reanimation, in accordance with some embodiments.

The reanimation, dubbing and/or modification of visual and/or audio content is typically performed through one or more processors of a computer, system and/or circuitry configured to perform the dubbing and/or modification of visual and/or audio content. FIG. 6 shows a simplified block diagram of an exemplary system 610 to perform reanimation, in accordance with some embodiments. The system includes reanimating circuitry and/or system 612 that is configured to provide reanimation. Further, the reanimation circuitry typically provides an automated reanimation with minimal user interaction. The reanimation circuitry 612 accesses the multimedia content to be reanimated and the dubbed vocalized content. The reanimating circuitry 612 is configured to evaluate the dubbed vocalized content, identify vocal sounds, and reanimate the frames to correspond to the dubbed vocalized content.

In some embodiments, the reanimating circuitry 612 accesses is a single stand alone device that performs the reanimation. In other embodiments, the reanimating circuitry is distributed over a local and/or distributed network 622. Additionally or alternatively, in some embodiments, the reanimating circuitry 612 communicates with one or more other devices and/or systems to acquire the primary multimedia content to be reanimated and/or the dubbed vocalized content. For example, in some embodiments the reanimating circuitry 612 is communicationally coupled with one or more content sources 614 (e.g., broadcast source, satellite source, Internet source, etc.).

Further, the reanimation circuitry 612 may be communicationally coupled with one or more databases and/or servers 616 that can provide the primary multimedia content and/or dubbed vocalized content. Additionally or alternatively, the reanimation circuitry 612 may store some or all of the mapping, reanimated content, primary frames or portions of primary frames mapped to vocal sounds, animation modeling, reanimation modeling, and/or other such information that can be utilized by the reanimating circuitry 612.

In some embodiments, the reanimating circuitry 612 is further communicationally coupled with one or more other sources of content and/or dubbed vocalized content and/or coupled with devices 618, 620 to playback the reanimated multimedia content. These playback devices 618, 620 can be substantially any relevant device configured to playback multimedia content that includes visual content, such as but not limited to, televisions, set-top-boxes, computers, laptops, smart phones, tablets, gaming devices, and substantially any other device configured to playback multimedia content.

The communication between the reanimating circuitry 612 and the one or more other devices and/or systems can be through direct coupling or over a distributed coupling, such as over a local area network (LAN), wide area network (WAN), the Internet, or other such coupling. Further, the communication may be implemented through wired communication, wireless communication, optical communication, or other such communication techniques, or combinations of such communication techniques.

Figure 7:
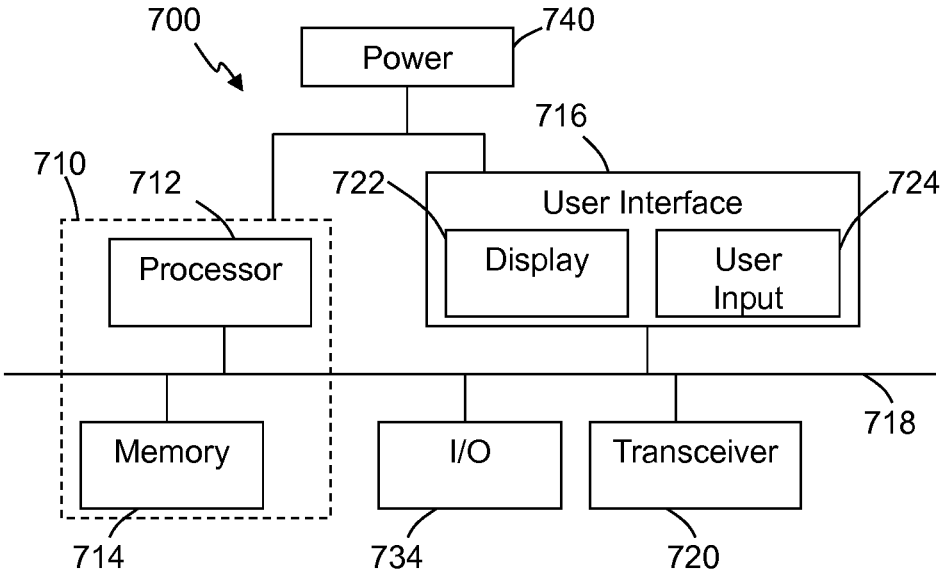
FIG. 7 illustrates exemplary circuitry or a system for use in implementing methods, techniques, circuitry, devices, apparatuses, systems, servers, sources and the like in providing reanimation in accordance with some embodiments.

The methods, techniques, circuitry, systems, devices, services, servers, sources and the like described herein may be utilized, implemented and/or run on many different types of devices and/or systems. Referring to FIG. 7, there is illustrated an exemplary system or circuitry 700 that may be used for any such implementations, in accordance with some embodiments. One or more components of the system 700 may be used for implementing any circuitry, system, apparatus or device mentioned above or below, or parts of such circuitry, systems, apparatuses or devices, such as for example any of the above or below mentioned reanimation system 610, reanimation circuitry 612, content source 614, database and/or server 616, playback devices 618, 620, dubbing system or circuitry, animation system or circuitry, camera, gaming device, video and/or image processing system, audio processing system, graphics generator system, controller, and the like. However, the use of the system 700 or any portion thereof is certainly not required.

By way of example, the system 700 may comprise a controller or processor module 712, memory 714, a user interface 716, and one or more communication links, paths, buses or the like 718. A power source or supply 740 is included or coupled with the system 700. The controller 712 can be implemented through one or more processors, microprocessors, central processing unit, computer, logic, local digital storage, firmware and/or other control hardware and/or software, and may be used to execute or assist in executing the steps of the methods and techniques described herein, and control various communications, programs, content, listings, services, interfaces, etc. The user interface 716 can allow a user to interact with the system 700 and receive information through the system. In some instances, the user interface 716 includes a display 722 and/or one or more user inputs 724, such as a keyboard, mouse, track ball, buttons, touch screen, remote control, game controller, etc., which can be part of or wired or wirelessly coupled with the system 700.

In some embodiments, the system 700 further includes one or more communication interfaces, ports, transceivers 720 and the like allowing the system 700 to communication over a distributed network, a local network, the Internet, communication link 720, other networks or communication channels with other devices and/or other such communications. Further the transceiver 720 can be configured for wired, wireless, optical, fiber optical cable or other such communication configurations or combinations of such communications.

The system 700 comprises an example of a control and/or processor-based system with the controller 712. Again, the controller 712 can be implemented through one or more processors, controllers, central processing units, logic, software and the like. Further, in some implementations the controller 712 may provide multiprocessor functionality.

The memory 714, which can be accessed by the controller 712, typically includes one or more processor readable and/or computer readable media accessed by at least the controller 712, and can include volatile and/or nonvolatile media, such as RAM, ROM, EEPROM, flash memory and/or other memory technology. Further, the memory 714 is shown as internal to the system 710; however, the memory 714 can be internal, external or a combination of internal and external memory. The external memory can be substantially any relevant memory such as, but not limited to, one or more of flash memory secure digital (SD) card, universal serial bus (USB) stick or drive, other memory cards, hard drive, optical disc, and other such memory or combinations of such memory. The memory 714 can store code, software, executables, scripts, animation modeling, other modeling, mapping, primary multimedia content, primary frames, portions of primary frames, reanimated portions of a character, dubbed vocalized content, vocal sounds, vocal sound identifiers, data, content, multimedia content, programming, programs, media stream, media files, textual content, identifiers, log or history data, user information and the like.

One or more of the embodiments, methods, processes, approaches, and/or techniques described above or below may be implemented in one or more computer programs executable by a processor-based system. By way of example, such a processor based system may comprise the processor based system 700, reanimation circuitry 612, a computer, server, database, a set-to-box, a television, an IP enabled television, a Blu-ray player, an IP enabled Blu-ray player, a DVD player, entertainment system, smart phone, tablet, gaming console, graphics workstation, etc., or combinations of such devices, circuitry and/or systems. Such a computer program may be used for executing various steps and/or features of the above or below described methods, processes and/or techniques. That is, the computer program may be adapted to cause or configure a processor-based circuitry or system to execute and achieve the functions described above or below. For example, such computer programs may be used for implementing any embodiment of the above or below described steps, processes or techniques for allowing the reanimation of multimedia content. As another example, such computer programs may be used for implementing any type of tool or similar utility that uses any one or more of the above or below described embodiments, methods, processes, approaches, and/or techniques. In some embodiments, program code modules, loops, subroutines, etc., within the computer program may be used for executing various steps and/or features of the above or below described methods, processes and/or techniques. In some embodiments, the computer program may be stored or embodied on a computer readable storage or recording medium or media, such as any of the computer readable storage or recording medium or media described herein.

Accordingly, some embodiments provide a processor or computer program product comprising a medium configured to embody a computer program for input to a processor or computer and a computer program embodied in the medium configured to cause the processor or computer to perform or execute steps comprising any one or more of the steps involved in any one or more of the embodiments, methods, processes, approaches, and/or techniques described herein. For example, some embodiments provide one or more computer-readable storage mediums storing one or more computer programs for use with a computer simulation, the one or more computer programs configured to cause a computer and/or processor based system to execute steps comprising: accessing multimedia content comprising primary visual content and corresponding primary audio content configured to be cooperatively played back by a multimedia playback device; accessing a plurality of dubbed vocalized content each intended to replace one of a plurality of primary vocalized content of the primary audio content; determining that a playback duration of a first dubbed vocalized content is different, by more than a threshold, than a playback duration of a first primary vocalized content of the plurality of primary vocalized content, wherein the first dubbed vocalized content is intended to replace the first primary vocalized content; identifying a first portion of the primary visual content corresponding to and intended to be played back in synchronization with the first primary vocalized content; modifying, through a processor, the first portion of the primary visual content by at least one of adding one or more frames and removing one or more frames, wherein the modifying the first portion of the primary visual content produces a first modified portion of the primary visual content, wherein the first modified portion of the primary visual content has a playback duration that is more consistent with the playback duration of the first dubbed vocalized content; evaluating the first dubbed vocalized content and identifying distinct vocal sounds within the first dubbed vocalized content; identifying a mouth shape corresponding to each of the distinct vocal sounds within the first dubbed vocalized content; and reanimating, through the processor, at least a portion of a first character depicted in the first modified portion of the primary visual content speaking the first primary vocalized content such that a depicted mouth of the first character is shaped consistent with and synchronized with the identified mouth shapes corresponding to each of the distinct vocal sounds within the first dubbed vocalized content.

Some embodiments provide methods of reanimating multimedia content, comprising: accessing multimedia content comprising primary visual content and corresponding primary audio content configured to be cooperatively played back by a multimedia playback device; accessing a plurality of dubbed vocalized content each intended to replace one of a plurality of primary vocalized content of the primary audio content; determining that a playback duration of a first dubbed vocalized content is different, by more than a threshold, than a playback duration of a first primary vocalized content of the plurality of primary vocalized content, wherein the first dubbed vocalized content is intended to replace the first primary vocalized content; identifying a first portion of the primary visual content corresponding to and intended to be played back in synchronization with the first primary vocalized content; modifying, through a processor, the first portion of the primary visual content by one of adding one or more frames and removing one or more frames, wherein the modifying the first portion of the primary visual content produces a first modified portion of the primary visual content, wherein the first modified portion of the primary visual content has a playback duration that is more consistent with the playback duration of the first dubbed vocalized content; evaluating the first dubbed vocalized content and identifying distinct vocal sounds within the first dubbed vocalized content; identifying a mouth shape corresponding to each of the distinct vocal sounds within the first dubbed vocalized content; and reanimating, through the processor, at least a portion of a first character depicted in the first modified portion of the primary visual content speaking the first primary vocalized content such that a depicted mouth of the first character is shaped consistent with and synchronized with the identified mouth shapes corresponding to each of the distinct vocal sounds within the first dubbed vocalized content.

Further, some embodiments provide apparatuses for use in reanimating video content, comprising: a processor configured to reanimate portions of visual content in cooperation dubbed vocalized content; and processor readable memory accessible by the processor and configured to store program code; wherein the processor is configured, when implementing the program code, to: access multimedia content comprising primary visual content and primary audio content configured to be played back by a multimedia playback device; access a plurality of dubbed vocalized content each intended to replace one of a plurality of primary vocalized content of the primary audio content; determine that a playback duration of a first dubbed vocalized content is different, by more than a threshold, than a playback duration of a first primary vocalized content of the plurality of primary vocalized content, wherein the first dubbed vocalized content is intended to replace the first primary vocalized content; identify a first portion of the primary visual content corresponding to and intended to be played back in synchronization with the first primary vocalized content; modify the first portion of the primary visual content by one of adding one or more frames and removing one or more frames, wherein the modifying produces a first modified portion of the primary visual content such that the first modified portion of the primary visual content has a playback duration that is more consistent with the playback duration of the first dubbed vocalized content; evaluate the first dubbed vocalized content and identify distinct vocal sounds within the first dubbed vocalized content; identify a mouth shape corresponding to each of the distinct vocal sounds within the first dubbed vocalized content; and reanimate at least a portion of a first character depicted in the first modified portion of the primary visual content speaking the first primary vocalized content such that a depicted mouth of the first character is shaped consistent with and synchronized with the identified mouth shapes corresponding to each of the distinct vocal sounds within the first dubbed vocalized content.

Exemplary processes and/or methods are representatively described above based on one or more flow diagrams, timing diagrams and/or diagrams representing sequences of actions and/or communications that include one or more steps, subprocesses, communications and/or other such representative divisions of the processes, methods, etc. These steps, subprocesses or other such actions can be performed in different sequences without departing from the spirit of the processes, methods and apparatuses. Additionally or alternatively, one or more steps, subprocesses, actions, etc. can be added, removed or combined in some implementations.

Although the above is generally described with reference to reanimation, the methods, process, techniques, circuitry, systems and apparatuses can also be applied in animating characters in the generation of primary content. In generating primary animation, some embodiments apply the mapping to the animation model to generate the animated character or a portion of the animated character. The primary vocalized content can be analyzed the mapping evaluated to find the corresponding modeling. The modeling is applied to generate the animation. Again, the modeling may be limited to a portion of the character that can be used in cooperation with other modeling for other portions of the character, the background, foreground, other characters, etc. When relevant, the animation is incorporate into the primary content.

As also described above, the reanimation or the primary animation may be evaluated. For example, a human reviewer may view the reanimation (or primary animation) and recommend or make relevant adjustments. Additionally or alternatively, some embodiments perform a comparison of the reanimated (or primary animation) to the mapping. Further, some embodiments evaluate based on reanimation relative to predict errors and/or errors learned over time. Still further, feedback can be received from viewers, whether professionals or general public.

While the invention herein disclosed has been described by means of specific embodiments, examples and applications thereof, numerous modifications and variations could be made thereto by those skilled in the art without departing from the scope of the invention set forth in the claims.

What is claimed is:

1. A method of reanimating multimedia content, comprising:

accessing multimedia content comprising primary visual content and corresponding primary audio content configured to be cooperatively played back by a multimedia playback device;

accessing a plurality of dubbed vocalized content each intended to replace one of a plurality of primary vocalized content of the primary audio content;

determining that a playback duration of a first dubbed vocalized content is different, by more than a threshold, than a playback duration of a first primary vocalized content of the plurality of primary vocalized content, wherein the first dubbed vocalized content is intended to replace the first primary vocalized content;

identifying a first portion of the primary visual content corresponding to and intended to be played back in synchronization with the first primary vocalized content;

modifying, through a processor, the first portion of the primary visual content such that a number of frames in the first portion of the primary visual content is changed, wherein the modifying the first portion of the primary visual content produces a first modified portion of the primary visual content, wherein the first modified portion of the primary visual content has a playback duration that is more consistent with the playback duration of the first dubbed vocalized content;

identifying a character movement corresponding to each distinct vocal sound within the first dubbed vocalized content; and reanimating, through the processor, at least a portion of a first character depicted in the first modified portion of the primary visual content speaking the first primary vocalized content such that reanimated character movements of the first character are consistent with and synchronized with the identified character movement corresponding to each of the distinct vocal sounds within the first dubbed vocalized content.

2. The method of claim 1, wherein the reanimating the at least the portion of the first character comprises:

obtaining a plurality of computer generated imagery (CGI) character modelings associated to the first character, wherein each of the plurality of character modelings correspond with at least one of the distinct vocal sounds within the first dubbed vocalized content; and rendering at least the portion of the first character while applying the selected plurality of character modelings such that the reanimated character movements of the first character are consistent with and synchronized with the identified character movements corresponding to each of the distinct vocal sounds within the first dubbed vocalized content.

3. The method of claim 2, wherein the reanimating the at least the portion of the first character comprises superimposing a rendered first character including the reanimated at least the portion of the first character with a separately rendered background.

4. The method of claim 1, further comprising:

modifying the first dubbed vocalized content such that a duration of playback is altered, in response to determining that the playback duration of the first dubbed vocalized content is different than the playback duration of the first primary visual content such that the modified first dubbed vocalized content has a modified playback duration; and determining whether the modified duration of the first dubbed vocalized content is different by more than the threshold than the playback duration of the first primary visual content;

wherein the modifying the first portion of the primary visual content comprises modifying the first portion of the primary visual content when the modified duration of the first dubbed vocalized content is different by more than the threshold than the playback duration of the first portion of the primary visual content.

5. The method of claim 1, wherein the modifying the first portion of the primary visual content comprises:

identifying metadata corresponding with the first portion of the visual content, wherein the metadata identifies characteristics regarding a background depicted behind and around the first character; and evaluating the metadata to identify one or more frames within the first portion of the visual content where modifications can be implemented;

wherein the modifying the first portion of the primary visual content comprises modifying the first portion of the primary visual content relative to at least one of the one or more frames identified from the evaluation of the metadata.

6. The method of claim 5, wherein the evaluating the metadata comprises identifying one or more frames where panning is occurring within the background, and identifying one or more frames where the background is substantially static and with which one or more frames may be added or removed without adversely affecting a visual continuity of the background.

7. The method of claim 1, further comprising:

identifying, by the processor and within the primary audio content, a sound effect that is configured to be played back during playback of the first primary vocalization content;

identifying one or more corresponding frames of the first portion of the primary visual content that are timed to be displayed as the sound effect is played back;

identifying one or more frames of the first modified portion of the primary visual content that correspond to the one or more frames of the first portion of the primary visual content that are timed to be displayed as the sound effect is played back; and modifying the primary audio content to adjust a timing of when the sound effect is to be played back such that the sound effect, when played back, is played back in synchronization with the displaying of the identified one or more frames of the first modified portion of the primary visual content to be played back while the sound effect is played back.

8. The method of claim 7, wherein the identifying the sound effect comprises accessing metadata corresponding to at least the audio content, wherein the metadata identifies the sound effect and further identifies the one or more corresponding frames of the first portion of the primary visual content; and wherein the reanimating comprises re-writing the metadata defining associating one or more of frames of the first modified portion of the visual content that correspond to the sound effect.

9. The method of claim 1, further comprising:

identifying, within the primary audio content, at least a portion of music configured to be played back while the first primary vocalized content is to be played back;

identifying one or more corresponding frames of the first portion of the primary visual content that are timed to be displayed while the at least the portion of the music is to be played back;

identifying one or more frames of the first modified portion of the primary visual content that correspond to the one or more frames of the first portion of the primary visual content that are timed to be displayed while the at least the portion of the music is to be played back; and modifying the primary audio content by one of increasing and decreasing a duration of playback of the at least the portion of the music such that at least a modified portion of the music is configured to be played back in synchronization with the displaying of the one or more frames of the first modified portion of the primary visual content.

10. The method of claim 1, wherein the reanimating the at least the portion of the first character comprises:

obtaining character modelings to mimic the identified character movements for each of the distinct vocal sounds within the first dubbed vocalized content;

mapping each of the distinct vocal sounds to one of the character modelings;

determining an orientation of the first character dubbed within the one or more frames;

wherein the reanimating at least the portion of the first character depicted in the first modified portion of the primary visual content producing reanimated portions of the first character;

applying the character modelings while compensating for orientation producing reanimated portions of the first character; and incorporating the reanimated portions of the first character into the first modified portion of the primary visual content.

11. The method of claim 1, further comprising:

identifying in the primary visual content one or more frames corresponding to distinct vocal sounds within the primary vocalized content;

extracting, relative each of the distinct vocal sounds within the primary vocalized content, at least a portion of the first character depicted in the primary visual content as the first character is speaking each of the distinct vocal sounds within the primary vocalized content;

associating each of the distinct vocal sounds within the primary vocalized content with one or more of the extracted portions of the first character depicted in the primary visual content speaking one of the distinct vocalized sounds within the primary vocalized content that corresponds to the distinct vocal sound within the primary vocalized content; and associating each of the distinct vocal sounds within the primary vocalized content with one or more of the extracted portions of the first character depicted in the primary visual content speaking the corresponding distinct vocalized sound; and wherein the reanimating at least the portion of the first character comprises replacing the at least the portion of the first character with one of the extracted portions of the first character associated with the dubbed vocalized sound.

12. The method of claim 11, wherein the replacing the at least the portion of the first character with one of the extracted portions of the first character associated with the dubbed vocalized sound comprises applying one or more blending techniques when replacing the portion of the first character with one of the extracted portions of the first character.

13. The method of claim 1, further comprising:

evaluating the first dubbed vocalized content and identifying the distinct vocal sounds within the first dubbed vocalized content.

14. An apparatus for use in reanimating video content, comprising:

a processor configured to reanimate portions of visual content in cooperation dubbed vocalized content; and processor readable memory accessible by the processor and configured to store program code;

wherein the processor is configured, when implementing the program code, to:

access multimedia content comprising primary visual content and primary audio content configured to be played back by a multimedia playback device;

access a plurality of dubbed vocalized content each intended to replace one of a plurality of primary vocalized content of the primary audio content;

determine that a playback duration of a first dubbed vocalized content is different, by more than a threshold, than a playback duration of a first primary vocalized content of the plurality of primary vocalized content, wherein the first dubbed vocalized content is intended to replace the first primary vocalized content;

identify a first portion of the primary visual content corresponding to and intended to be played back in synchronization with the first primary vocalized content;

modify the first portion of the primary visual content such that a number of frames in the first portion of the primary visual content is changed, wherein the modifying produces a first modified portion of the primary visual content such that the first modified portion of the primary visual content has a playback duration that is more consistent with the playback duration of the first dubbed vocalized content;

identify a character movement corresponding to each distinct vocal sound within the first dubbed vocalized content; and reanimate at least a portion of a first character depicted in the first modified portion of the primary visual content speaking the first primary vocalized content such that reanimated character movements of the first character are consistent with and synchronized with the identified character movements corresponding to each of the distinct vocal sounds within the first dubbed vocalized content.

15. The apparatus of claim 14, wherein the processor in implementing the program code is further configured to:

identify a sound effect that is configured to be played back during playback of the first primary vocalization content;

identify one or more corresponding frames of the first portion of the primary visual content that are timed to be displayed as the sound effect is played back;

identify one or more frames of the first modified portion of the primary visual content that correspond to the one or more frames of the first portion of the primary visual content that are timed to be displayed as the sound effect is played back; and modify the primary audio content to adjust a timing of when the sound effect is to be played back such that the sound effect, when played back, is played back in synchronization with the displaying of the identified one or more frames of the first modified portion of the primary visual content to be played back while the sound effect is played back.

16. The apparatus of claim 14, wherein the processor in modifying the first portion of the primary visual content is further configured to:

identify metadata corresponding with the first portion of the visual content, wherein the metadata identifies characteristics regarding a background depicted behind and around the first character; and evaluate the metadata to identify one or more frames within the first portion of the visual content where modifications can be implemented;

wherein the modifying the first portion of the primary visual content comprises modifying the first portion of the primary visual content relative to at least one of the one or more frames identified from the evaluation of the metadata.

17. The apparatus of claim 14, wherein the processor in reanimating the at least the portion of the first character is further configured to:

identifying a plurality of computer generated imagery (CGI) character modelings associated to the first character, wherein each of the plurality of character modelings correspond with at least one of the distinct vocal sounds within the first dubbed vocalized content; and render at least the portion of the first character while applying the selected plurality of character modelings such that the reanimated character movements of the first character are consistent with and synchronized with the identified character movements corresponding to each of the distinct vocal sounds within the first dubbed vocalized content.

18. The apparatus of claim 17, wherein the processor in reanimating the at least the portion of the first character is further configured to superimpose the rendered first character including the reanimated at least the portion of the first character with a separately rendered background.

19. The method of claim 14, wherein the processor in implementing the program code is further configured to:

identify in the primary visual content one or more frames corresponding to distinct vocal sounds within the primary vocalized content;

extract, relative each of the distinct vocal sounds within the primary vocalized content, at least a portion of the first character depicted in the primary visual content as the first character is speaking each of the distinct vocal sounds within the primary vocalized content;

associate each of the distinct vocal sounds within the primary vocalized content with one or more of the extracted portions of the first character depicted in the primary visual content speaking one of the distinct vocalized sounds within the primary vocalized content that corresponds to the distinct vocal sound within the primary vocalized content; and associate each of the distinct vocal sounds within the primary vocalized content with one or more of the extracted portions of the first character depicted in the primary visual content speaking the corresponding distinct vocalized sound; and wherein the processor in reanimating at least the portion of the first character is further configured to replace the at least the portion of the first character with one of the extracted portions of the first character associated with the dubbed vocalized sound.

20. A method of reanimating multimedia content, comprising:

accessing multimedia content comprising primary visual content and corresponding primary audio content configured to be cooperatively played back by a multimedia playback device;

accessing a plurality of dubbed vocalized content each intended to replace one of a plurality of primary vocalized content of the primary audio content;

identifying a first portion of the primary visual content corresponding to and intended to be played back in synchronization with the first primary vocalized content;

modifying the first portion of the primary visual content such that a number of frames is changed with a playback duration that is more consistent with a playback duration of a first dubbed vocalized content;

identifying a character movement corresponding to each distinct vocal sound within the first dubbed vocalized content, wherein the first dubbed vocalized content is intended to replace the first primary vocalized content; and reanimating, through a processor, at least a portion of a first character depicted in the first portion of the primary visual content speaking the first primary vocalized content by applying computer generated imagery (CGI) character modeling to generate reanimated character movements of the first character such that the reanimated character movements of the first character are consistent with and synchronized with the identified character movement corresponding to each of the distinct vocal sounds within the first dubbed vocalized content.

21. A method of reanimating multimedia content, comprising:

accessing multimedia content comprising primary visual content and corresponding primary audio content configured to be cooperatively played back by a multimedia playback device;

accessing a plurality of dubbed vocalized content each intended to replace one of a plurality of primary vocalized content of the primary audio content;

determining that a playback duration of a first dubbed vocalized content is different, by more than a threshold, than a playback duration of a first primary vocalized content of the plurality of primary vocalized content, wherein the first dubbed vocalized content is intended to replace the first primary vocalized content;

identifying a first portion of the primary visual content corresponding to and intended to be played back in synchronization with the first primary vocalized content;

modifying, through a processor, the first portion of the primary visual content such that a number of frames in the first portion of the primary visual content is changed, wherein the modifying the first portion of the primary visual content produces a first modified portion of the primary visual content, wherein the first modified portion of the primary visual content has a playback duration that is more consistent with the playback duration of the first dubbed vocalized content; and identifying a character movement corresponding to each distinct vocal sound within the first dubbed vocalized content.

* * * * *